United States Patent [19]

Schooley

[11] Patent Number: 4,615,347

[45] Date of Patent: Oct. 7, 1986

[54] SCENT DISK FOR HAIR DRYER

[76] Inventor: Teresa D. Schooley, 2815 Bayview Dr., Naples, Fla. 33962

[21] Appl. No.: 621,703

[22] Filed: Jun. 18, 1984

[51] Int. Cl.[4] ..... A45D 1/00

[52] U.S. Cl. ..... 132/9; 219/222

[58] Field of Search ..... 132/9; 30/133; 34/97, 34/60; 219/222

[56] References Cited

U.S. PATENT DOCUMENTS

| | | | |
|---|---|---|---|
| 2,827,060 | 3/1958 | Marty | 132/9 |
| 4,232,454 | 11/1980 | Springer | 34/97 |
| 4,314,405 | 2/1982 | Park | 132/9 |

FOREIGN PATENT DOCUMENTS

| | | | |
|---|---|---|---|
| 582831 | 10/1958 | Italy | 34/97 |

*Primary Examiner*—Gregory E. McNeill

*Attorney, Agent, or Firm*—Merrill N. Johnson

[57] ABSTRACT

An attachment for a hair dryer which adds a scent or perfume to the warm air blowing out of a hair dryer. The attachment consists of a disk designed to fit onto the front end of a conventional hair dryer. The disk includes an annular ring with an outer diameter of approximately $1\frac{3}{4}$ inches and an inner diameter of approximately $1\frac{1}{2}$ inches surrounding and supporting an open screen of vertical and horizontal strands of nylon or other inert plastic resin. Each intersection of the screen's strands supports a bead of volatizable scent. The screen and its beads of scent are protected during storage of the disk prior to use by two circles of foil removably mounted by means of adhesive onto the opposite sides of the disk's ring. The foils are removed just prior to fitting the disk onto a blow dryer. The disk is mounted over the mouth of the blow dryer, preferably by a cylindrical sheath of thin flexible latex, one end of which is attached to the outer surface of the disk's ring. Prior to use, the sheath is rolled up around the outside of the disk's ring.

6 Claims, 5 Drawing Figures

SCENT DISK FOR HAIR DRYER

BACKGROUND AND SUMMARY OF THE INVENTION

My invention relates to an attachment for a hair dryer and in particular to an attachment which adds a scent or perfume to the warm air being blown from a blow dryer or conventional hair dryer.

In recent years, for various reasons, electrically powered and heated hair dryers called blow dryers have become very popular for use at home by both men and women, as well as in barber shops, unisex hair styling centers and ladies beauty parlors. Many users of blow dryers also deisre to scent or perfume their hair and resort to various means of scenting their hair immediately before or after blow drying the hair.

Although a hair dryer that would also scent the hair was proposed in U.S. Pat. No. 2,827,060 issued Mar. 18, 1958, as far as I am aware no practical device has been available on the market which combines the operations of blow drying and scenting the hair at the same time.

I have invented an attachment designed to fit onto most conventional blow dryers which adds a pleasing scent to the warm air being blown from the dryer. My attachment does not interfere with the blowing or heating mechanism of the dryer or lessen the velocity of the warm air blown from the mouth of the dryer. It is relatively inexpensive to use as compared with alternate methods of scenting the hair such as aersol sprays and it is quite simple to install on the dryer.

My attachment, in the form of a disk, fits onto the front end of the dryer. The disk includes an annular ring having an outer diameter of approximately 1-$\frac{3}{4}$ inches and an inner diameter of approximately 1-$\frac{1}{2}$ inches enclosing and supporting an open screen constructed of vertical and horizontal strands of nylon. Each intersection of the screen's vertical and horizontal strands supports a spherical bead of volatizable scent or perfume. The screen and its beads of scent are protected from deterioration during storage prior to use by two similar circles of foil removably attached by adhesive onto the opposite sides of the disk's ring. These foils are removed just prior to fitting the disk onto a blow dryer.

Although other means may be used, the disk is preferably mounted over the mouth of the blow dryer by a cylindrical sheath of thin flexible latex, one end of which is bonded to the outer surface of the disk's ring. Prior to use, the latex sheath is rolled up around the outside of the ring.

In use, the disk fits across the path of the warm air being blown from the dryer thus exposing the volatizable beads of scent directly to the moving stream of warm air. This, of course, causes volatization of the scent which mixes with the air moving toward the hair being blown dry. Thus the hair is both dried and scented at the same time.

DETAILED DESCRIPTION OF THE PREFERRED EMBODIMENT

Figure 1:
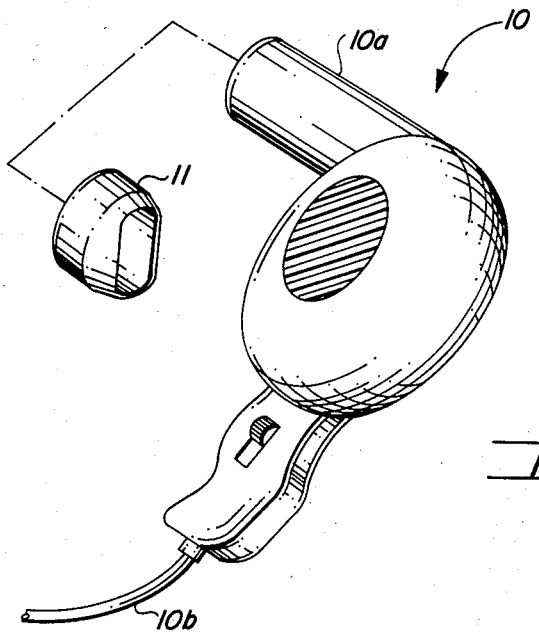
FIG. 1 (PRIOR ART)
FIG. 1 is a perspective view of a conventional electrically powered hair dryer to which my unique scent disk is to be attached.

Referring to the drawings which illustrate a preferred embodiment of my scent disk but which are not intended to limit the scope of the invention, FIG. 1 is a perspective view of a conventional electric hair dryer 10 with its cylindrical nozzle 10*a* and electric cord 10*b*. Dryer 10 also includes a fitting 11 designed to be slipped on over the end of a dryer nozzle 10*a* which channels the air stream from dryer 10 into a flat oval pattern due to the shape of the mouth of fitting 11.

Figure 2:
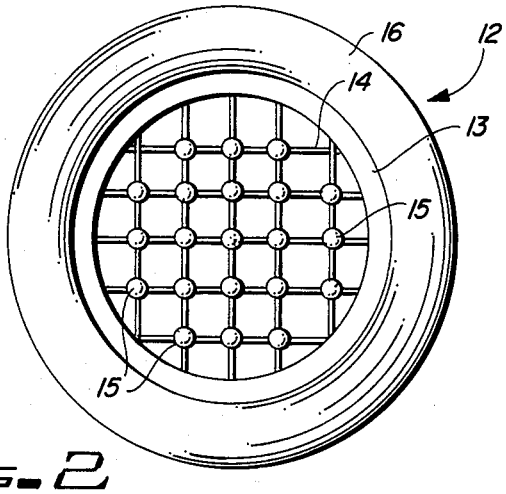
FIG. 2 is a frontal view of a preferred embodiment of my scent disk with its protective foil removed.
Figure 3:
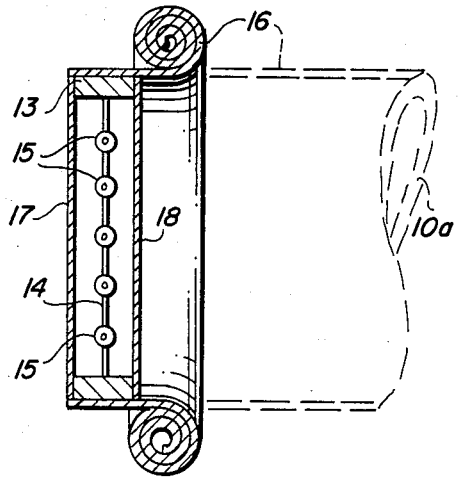
FIG. 3 is a cross-sectional view of the scent disk shown in FIG. 2 but with the two protective foils attached.

FIGS. 2 and 3 show in detail the major components of my unique scent disk 12. Disk 12 includes an annular ring 13 preferably molded of nylon or other inert plastic which retains its structural integrity at temperatures of at least 150° C. Ring 13 preferably has an outside diameter approximately 1-$\frac{3}{4}$ inches and an inside diameter approximately 1-$\frac{1}{2}$ inches and a thickness of approximately $\frac{3}{8}$ths of an inch. Ring 13 surrounds and supports an open screen of horizontal and vertical nylon strands 14 which screen is preferably molded together with ring 13.

Each intersection of horizontal and vertical strands 14 supports a generally spherical bead 15 of solid but volatizable scent or perfume. Bead 15 is solid at room temperature but is slowly volatized by a stream of warm air such as generated by a conventional blow dryer, that is, at least 40° C. and preferably 50° C.

In order to prevent aromatic deterioration of scent beads 15 during storage and before use of disk 12, a pair of circular foils 17 and 18 are removably attached by a suitable adhesive to the opposite sides of ring 13 as shown in FIG. 3. Foils 17 and 18 are removed from disk 12 immediately prior to mounting disk 12 on the end of dryer nozzle 10*a*.

Disk 12 is capable of being mounted on the end of a conventional dryer in several different ways. Preferably disk 12 is supplied with a cylindrical sheath 16, one end of which is bonded to outer edge of ring 13. Sheath 16 is made of a resiliant, flexible material such as latex so that it will fit snugly over the nozzle of a blow dryer despite the exact size or configuration of the end of the nozzle. Prior to use, sheath 16 is rolled up upon itself as best shown in FIG. 3.

Figure 4:
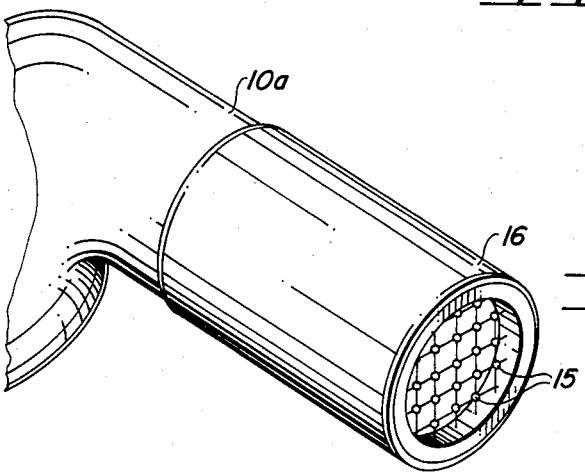
FIG. 4 is a perspective view of the scent disk attached to the front end of a conventional hair dryer.

FIG. 4 shows disk 12 mounted over the mouth of dryer nozzle 10*a* with sheath 16 unrolled over the end of nozzle 10*a*. Alternatively, the fitting 11 can first be slipped on the end of dryer nozzle 10*a*, and then disk 12 fixed over the mouth of the fitting 11 by unrolling sheath over the outside of fitting 11 and nozzle 10*a*.

Figure 5:
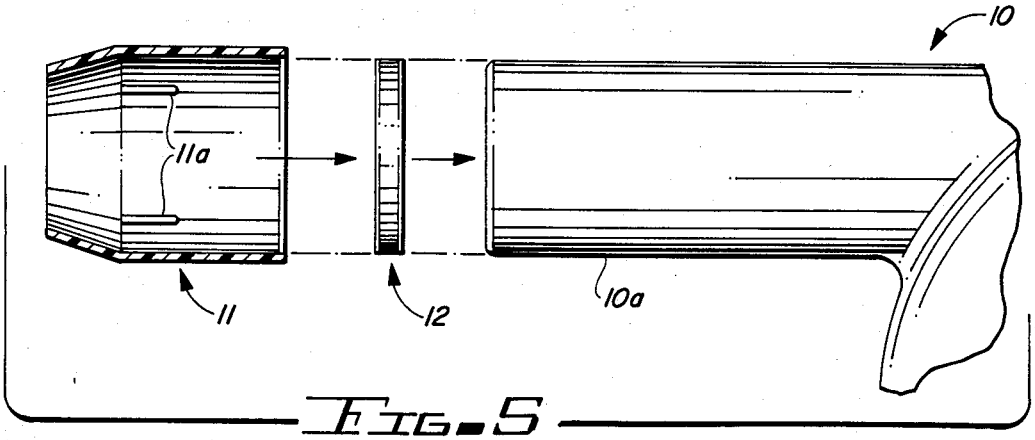
FIG. 5 is an exploded view partly in cross-section showing an alternate means of attaching my scent disk to the front end of a conventional hair dryer.

FIG. 5 shows a further alternative way of mounting scent disk 12 onto the nozzle of a conventional dryer. First, sheath 16 and foils 17 and 18 are stripped off the disk shown in FIG. 3. Then the disk 12 is pressed against the mouth of dryer nozzle 10*a* and fitting 11 is slipped over the end of the dryer nozzle to secure disk 12 between the front edge of nozzle 10*a* and the rear ends of stops 11*a* molded into the inner surface of fitting 11.

Regardless of whether disk 12 is mounted as shown in FIG. 4 or FIG. 5, its function as a part of the operation of the blow dryer is the same. When the dryer's rotary fan and heating elements are turned on, heated air is blown out of the mouth of nozzle 10*a* and the stream of warm air is directed onto the head of hair to be blow dried. As this stream of warm air is directed against scent beads 15 supported on strands 14, the outside surfaces of the scent beads will be volatized and the volatized scent mixed with the stream of warm air. Thus the hair will be both blow dried and scented at the same time. Of course, various scents or perfumes can be used to form beads 15 as desired to appeal to men and women of differing ages and backgrounds.

While I have shown and described a preferred embodiment of my scent disk for a hair dryer, different forms and modifications will be apparent to those skilled in the art without departing from the spirit of my invention, whose scope is limited only by the following claims.

I claim:

1. An attachment for an electrically powered hair dryer designed to impart a desired scent to the hair being dried comprising an annular ring, an open screen made of intersecting horizontal and vertical strands attached to and surrounded by said annular ring, a plurality of beads of scented material attached to and supported at the intersections of the strands of said screen, said scented material being solid at room temperature and volatizable by exposure to a stream of moving air having a temperature of at least 40° C., a pair of circular foils removably attached to the opposite sides of the ring and covering the screen and its attached beads without touching said beads, and a cylindrical sheath of thin flexible material having one end of said sheath bonded to the outer edge of said ring.

2. An attachment for an electrically powered hair dryer as set forth in claim 1 wherein the annular ring and the strands of the open screen are made of nylon.

3. An attachment for an electrically powered hair dryer as set forth in claim 1 in which the annular ring has an outer diameter of 1-$\frac{3}{4}$ inches, an inner diameter of 1-$\frac{1}{2}$ inches, and a width of $\frac{3}{8}$ths of an inch.

4. An attachment for an electrically powered hair dryer designed to impart a desired scent to the hair being dried comprising an annular ring, an open screen made of intersecting strands attached to and surrounded by said annular ring, and a plurality of beads of scented material attached to and supported by the strands of said screen, said scented material being solid at room temperature and volatizable by exposure to a stream of moving air having a temperature of at least 40° C.

5. An attachment for an electrically powered hair dryer designed to impart a desired scent to the hair being dried comprising an annular ring having an outside diameter of approximately 1-$\frac{3}{4}$ inches, an open screen made of intersecting strands attached to and surrounded by said annular ring, a plurality of beads of scented material attached to and supported by the strands of said screen, said scented material being solid at room temperature and volatizable by exposure to a stream of moving air having a temperature of at least 40° C., and a pair of circular moisture-impervious foils removably attached to the opposite sides of the ring so as to cover the screen and its attached beads without touching said beads.

6. An attachment for an electrically powered hair dryer as set forth in claim 4 which includes a cylindrical sheath of latex having a diameter of approximately 1-$\frac{3}{4}$ inches with one end of said sheath bonded to the outer edge of the annular ring.

* * * * *